US010463108B2

(12) United States Patent
Martinson

(10) Patent No.: US 10,463,108 B2
(45) Date of Patent: Nov. 5, 2019

(54) LACING DEVICE AND SYSTEMS AND METHOD THEREFOR

(71) Applicant: NITE IZE, INC., Boulder, CO (US)

(72) Inventor: Daniel J. Martinson, Medina, MN (US)

(73) Assignee: Nite Ize, Inc., Boulder, CO (US)

( * ) Notice: Subject to any disclaimer, the term of this patent is extended or adjusted under 35 U.S.C. 154(b) by 0 days.

(21) Appl. No.: 15/612,931

(22) Filed: Jun. 2, 2017

(65) Prior Publication Data

US 2017/0265570 A1 Sep. 21, 2017

Related U.S. Application Data

(63) Continuation of application No. PCT/US2015/063454, filed on Dec. 2, 2015.

(60) Provisional application No. 62/087,682, filed on Dec. 4, 2014.

(51) Int. Cl.
*A43C 9/00* (2006.01)

(52) U.S. Cl.
CPC ..... *A43C 9/00* (2013.01); *Y10T 24/37* (2015.01); *Y10T 24/3787* (2015.01)

(58) Field of Classification Search
CPC ..... A43C 9/00; Y10T 24/37; Y10T 24/3787
See application file for complete search history.

(56) References Cited

U.S. PATENT DOCUMENTS 780,377 A * 1/1905 Nicholls ..... A43C 9/00 24/713
920,646 A * 5/1909 Prentice ..... A43C 7/00 147/48
1,061,780 A * 5/1913 Rogers ..... A43C 7/00 24/575.1
1,775,013 A 9/1930 Yugawa
2,004,702 A 6/1935 Luttmann, Jr.
4,930,196 A * 6/1990 Laurin ..... A43C 9/00 24/715.3
5,023,982 A * 6/1991 Mehan ..... A43C 9/00 24/715.3
5,111,558 A 5/1992 Ridley et al.
5,778,499 A * 7/1998 Lehrman ..... A43B 1/0081 24/712
6,212,743 B1 * 4/2001 Cohen ..... A43C 9/00 24/306
D768,376 S * 10/2016 Martinson ..... D2/978

(Continued)

FOREIGN PATENT DOCUMENTS

GB 596562 A 1/1948
GB 2411570 A 9/2005

OTHER PUBLICATIONS

Search Report issued in related PCT application No. PCT/US2015/063454 dated Feb. 15, 2016 (2 pages).

(Continued)

*Primary Examiner* — Robert Sandy
*Assistant Examiner* — Michael S Lee
(74) *Attorney, Agent, or Firm* — Haynes and Boone, LLP

(57) ABSTRACT

A lacing device includes a lace body, the lace body having a length, width, depth, and cross-sectional area spanning the width and the depth of the lace body, the cross-sectional area of the lace body shaped such that the lace body is prone to folding about a middle area of the width when the lace body is compressed.

23 Claims, 3 Drawing Sheets

(56) References Cited

U.S. PATENT DOCUMENTS

| | | | | |
|---|---|---|---|---|
| 2003/0177662 | A1 | 9/2003 | Elkington et al. | |
| 2003/0186024 | A1 | 10/2003 | Walsh | |
| 2004/0216799 | A1* | 11/2004 | Tseng | A43C 9/00 139/421 |
| 2005/0217089 | A1* | 10/2005 | Lin | A43C 9/00 24/712 |
| 2009/0297793 | A1 | 12/2009 | Yun | |
| 2012/0151795 | A1* | 6/2012 | Ivester | A43C 1/00 36/83 |
| 2014/0041167 | A1 | 2/2014 | Simmons | |
| 2014/0223769 | A1* | 8/2014 | Dekovic | A43B 5/02 36/83 |
| 2015/0237951 | A1* | 8/2015 | Hilderbrand, IV | A43B 5/02 36/115 |
| 2018/0009584 | A1* | 1/2018 | Martinson | B65D 63/04 |

OTHER PUBLICATIONS

Written Opinion issued in related PCT application No. PCT/US2015/063454 dated Feb. 15, 2016 (10 pages).

International Preliminary Report on Patentability issued in related PCT application No. PCT/US2015/063454 dated Jun. 6, 2017 (11 pages).

* cited by examiner

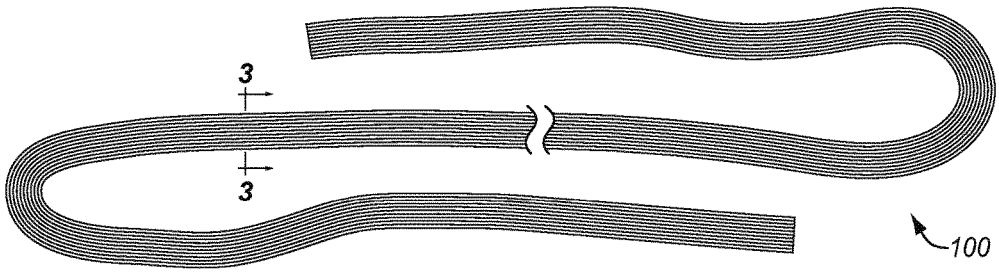
FIG. 1
FIG. 2
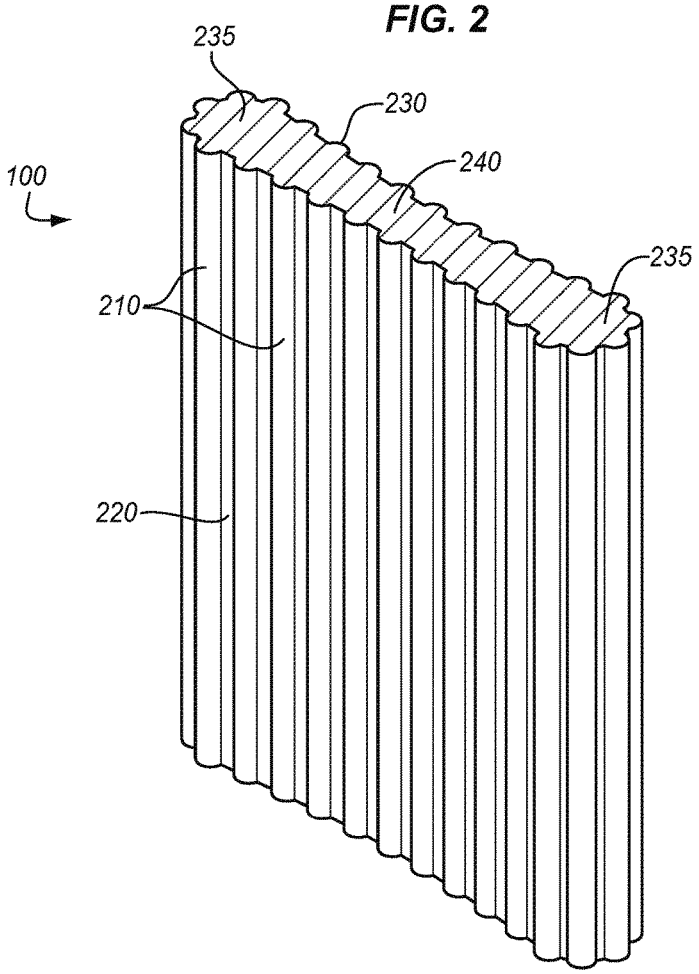

LACING DEVICE AND SYSTEMS AND METHOD THEREFOR

CROSS-REFERENCES TO RELATED APPLICATIONS

This application is a continuation of PCT application Ser. No. PCT/US2015/063454 filed on Dec. 2, 2015, which PCT application claims the benefit of U.S. Provisional Application No. 62/087,682 filed Dec. 4, 2014. The above PCT and provisional patent applications are hereby incorporated by reference to the same extent as though fully contained herein.

TECHNICAL FIELD

Embodiments described herein generally relate to improved lacing devices and systems and method for using them.

BACKGROUND

Laces are the most common device used in the closure of various types of footwear and may be used in a variety of other contexts for closing apertures in clothing or other items including a fabric-like or leather-like component. Existing laces have a variety of disadvantages, including that they must be tied and untied in order to remove and put on the shoe.

SUMMARY

In one embodiment, a lacing device includes a lace body, the lace body having a length, width, depth, and cross-sectional area spanning the width and the depth of the lace body, the cross-sectional area of the lace body shaped such that the lace body is prone to folding about a middle area of the width when the lace body is compressed. Optionally, the cross-sectional area of the lace body has a narrow profile in the depth in the middle area as compared to edge areas outside the middle area of the width. Alternatively, the cross-sectional area has a dogbone shape. In one alternative, the lace body includes a plurality of ridges. In another alternative, the plurality of ridges runs parallel to the length of the lace body. Optionally, the lace body is composed of thermal plastic urethane (TPU). Alternatively, the lace body has a durometer of 65-75 shore A. Optionally, the lace body includes a slip additive.

In another embodiment, a lacing device includes a lace body, the lace body having a length, width, depth, and cross-sectional area spanning the width and the depth of the lace body, the cross-sectional area of the lace body shaped such that the lace body is prone to folding about a middle area of the width when the lace body is compressed, the lace body having a first configuration where the lace body is not under compressive force, and a second configuration where the lace body is under compressive force, the first configuration characterized by the lace body having a flat profile, the second configuration characterized by the lace body being folded about the middle area of the width. Optionally, the compressive force is a result of tying the lace body around itself. In one alternative, the cross-sectional area of the lace body has a narrow profile in the depth in the middle area as compared to edge areas outside the middle area of the width. Alternatively, the lace body includes a plurality of ridges, and the plurality of ridges run parallel to the length of the lace body. Optionally, in the second configuration, when the lace body is tied around itself, the plurality of ridges compresses and mechanically interacts with each other due to the compressive force. In one configuration, the lace body is composed of thermal plastic urethane (TPU), the lace body has a durometer of 65-75 shore A, and the lace body includes a slip additive.

In one embodiment, a method of using a lacing device includes providing the lacing device, the lacing device having a lace body, the lace body having a length, width, depth, and cross-sectional area spanning the width and the depth of the lace body, the cross-sectional area of the lace body shaped such that the lace body is prone to folding about a middle area of the width when the lace body is compressed. The method further includes lacing a shoe with the lacing device and tying the lacing device wherein the tying causes the lace body to fold about the middle area of the width. Optionally, the method further includes stretching the lacing device to remove the shoe without untying the lacing device. In one alternative, the cross-sectional area of the lace body has a narrow profile in the depth in the middle area as compared to edge areas outside the middle area of the width. Alternatively, the lace body includes a plurality of ridges, and the plurality of ridges run parallel to the length of the lace body. Optionally, in the second configuration, when the lace body is tied around itself, the plurality of ridges compresses and mechanically interacts with each other due to the compressive force. In one configuration, the lace body is composed of thermal plastic urethane (TPU), the lace body has a durometer of 65-75 shore A, and the lace body includes a slip additive.

In an alternative embodiment, a lacing device includes a lace body, wherein the lace body includes a plurality of ridges, the plurality of ridges run parallel to the length of the lace body. Optionally, the lace body is composed of thermal plastic urethane (TPU). Alternatively, the lace body has a length, width, depth, and cross-sectional area spanning the width and the depth of the lace body, the cross-sectional area of the lace body shaped such that the lace body is prone to folding about a middle area of the width when the lace body is compressed. Optionally, the cross-sectional area of the lace body has a narrow profile in the depth in the middle area as compared to edge areas outside the middle area of the width. Alternatively, the cross-sectional area has a dogbone shape. In one alternative, the lace body has a durometer of 65-75 shore A. In another alternative, the lace body includes a slip additive.

BRIEF DESCRIPTION OF THE DRAWINGS

FIG. 1 shows a perspective view of one embodiment of an improved lacing device;

FIG. 2 shows a perspective cutaway view of the improved lacing device of FIG. 1;

DETAILED DESCRIPTION OF THE DRAWINGS

Figure 3:
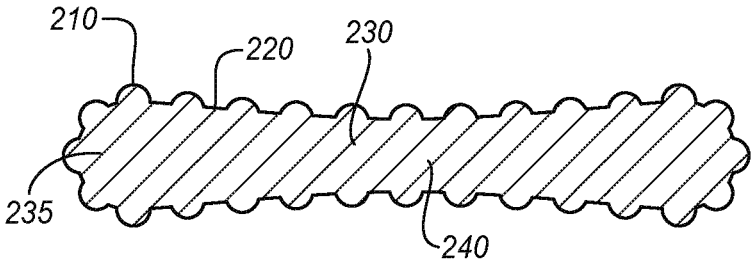
FIG. 3 shows a cross-section of the improved lacing device of FIG. 1.

Described herein are embodiments of various improved lacing devices. In many embodiments, the improved lacing device is designed so that it will not easily wear out. In many embodiments, the improved lacing device is designed so that when laced in a shoe, the shoe may be slipped on and off without untying the shoe. In many embodiments, the improved lacing device is composed of thermal plastic urethane (TPU).

Unlike other "elastomers", TPU has very high tear, tensile, and elongation properties at lower durometers (hardness). These properties are very important in order for the lace to survive the abuse in the shoe. Laces tend to wear out in the eyelets—very sharp edge against high tension.

FIG. 1 shows one embodiment of an improved lacing device. As visible in this figure, the improved lacing device 100 (also referred to as "laces" or "a lacing device") has a similar shape and feel to an ordinary shoe lace. FIG. 2 shows a perspective view of improved lacing device 100. In this view, many of the features of the device may be appreciated. Improved lacing device 100 includes ridges 210 that are raised in comparison to the surface 220 of improved lacing device 100. Improved lacing device 100 includes a specially shaped profile 230. In this profile shape, improved lacing device 100 has an approximately dogbone shape and includes thicker portions 235 along the sides of improved lacing device 100 and a narrower portion 240 in the middle of improved lacing device 100.

FIG. 3 shows a cross-section of improved lacing device 100. Here, the ribs 210 and the surface 220 are clearly shown. Additionally, the dogbone shape of cross-section 230 is visible having thicker portions 235 and the narrower middle portion 240.

Figure 4:
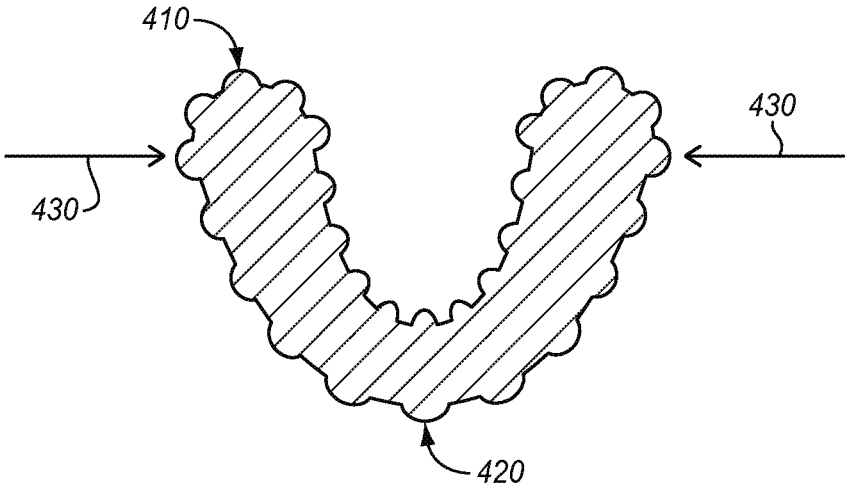
FIG. 4 shows a folded cross-section of the improved lacing device of FIG. 1.

The dogbone shape is an example of one advantageous shape for improved lacing device 100. The shape provides for increased toughness and durability due to the thicker portions 235 as compared to a uniform lace having a skinnier cross section, like that of narrower portion 240. The shape also makes the lace fold at center when going through an eyelet of a shoe or other object. This allows improved lacing device 100 to pass through the eyelet easily due to the deformation. A simple rectangle would not deform/fold as consistently, which would make the lace hard to pull through. Second, this shape makes the lace fold on itself in the knot when tied, which allows the shape to be compressed and the knot to stay tied. A circle or football shape will not deform/fold in the knot matrix. Rather, those shapes would need to be compressed. A solid polymer lace can only deflect its volume as it is compressed. In this case, the circle or football shape lace in a knot would often untie itself as the material wants to spring back. This is because more elastic force is stored and released by the compressed circular shape and, by folding the lace in the middle, a lever arm is created to resist the unfolding. The lever arm runs from the midpoint of the improved lacing device 100 where it folds to the edge of the lace where thicker portion 235 is. Therefore, force keeping the lace folded is multiplied compared to the force provided by the elastic nature of the improved lacing device 100. FIG. 4 shows a folded cross-section of improved lacing device 100. The lever arm stretches from end point 410 to center point 420. When a force 430 provided by tying the improved lacing device 100 is applied, the body bends at point 420. Therefore, the elasticity and compression stored by bending the lace must provide a force that overcomes force 430 and the leverage provided by lever the lever arm. Furthermore, a dogbone shape tends to tangle up its shape better and stay tied as the entire shape is folded and compressed.

Although the dogbone shape is preferred for the improved lacing device 100, other lace shapes can accomplish similar functions. For example, any design that provides for a break point in the middle of the lace may be substituted for the dogbone shape. A break (or bend point) does not mean that the lace physically separates at the break point. Instead, it is the point where the lace will naturally bend when pressure is applied to it. A break point may be arranged by having a thinner portion in the middle of the lace as compared to the ends. Therefore, in alternative embodiments, the thicker portions 235 may be any shape and configuration that makes sense for a lace as long as the middle of the lace includes a narrower portion 240 where natural bending/folding may occur.

Ribs 210 offer numerous advantages. Ribs 210 reduce the surface contact area on the lace. This makes it easier to pull the lace through the eyelets because of the smaller contact surface area. This is important because the material has a high coefficient of friction and having less surface contact, thereby naturally reducing friction. Second, ribs 210 make it easier to pull the knot tight. This is because the ribs break up and reduce the surface contact between the laces when being tied, allowing the user to pull the lace into a knot. When the lace knot assembly is pulled tight, the ribs actually cross directions against the opposing lace in the knot assembly. Under the compression of the knot, the ribs actually create a mechanical interference, which helps keep the knot tied. If the lace was a smooth surface, it would be much easier for the knot to untie itself, especially when wet.

Ribs 210 create a water space for water to drain away from the knot and help keep the knot tied. Urethane and many other materials get slippery when in contact with water. If the lace was a flat surface, the water would sandwich between the flat surfaces of the laces and come untied. The ribs prevent this from happening.

In other embodiments, the improved lacing device 100 has a smooth surface or includes an alternative pattern. Other patterns may have disadvantages as compared to the ribs. Bumps, or squares, or other broken patterns make it difficult to pull the lace through the eyelet and also make it harder to pull the knot tight. This is because the bumps or broken patterns may cause mechanical interference. Alternative beneficial patterns may include wave-like patterns or z-like patterns, especially those that are continuous; however, these patterns may not provide for the ready creation of a break or folding point as described above.

The material used and the durometer of the material may be used to configure a beneficially operating lace. TPU has many advantages over alternative materials. TPU is an elastomer that will work for this application because of its high abrasion resistance, elasticity, and tensile strength. A durometer of 70 A (+/−) 5 durometer for the TPU provides enhanced function for many of the shapes disclosed herein. A durometer of greater than 75 A may be too hard. This is because the lace may not stretch sufficiently to stay tied. Durometers lower than 65 may be too soft with the shapes disclosed herein. This is because the lace does not provide sufficient tension at the lower durometer to function correctly as a shoe lace. Essentially, if the material is too stretchy, it doesn't provide enough support, is too hard to pull tight in the knot assembly, and stretches too much. The proposed durometers hold true for laces that are of standard lace widths. For laces having greater thickness, a lower durometer may be used; however, these laces may not fit in standard shoes and eyelets.

In some embodiments, the lace includes a slip additive. By itself, TPU may be a bit too sticky for use as a lace. This stickiness makes it hard to pull a knot together. A thermoplastic slip agent may be added to the TPU during the extrusion process to reduce this stickiness. This slip agent may reduce the friction of the surface of the TPU lace just enough to allow the lace to slip past itself when tied into a knot. The TPU may still remain grippy/sticky enough for the dog bone shape to still work under compression. In many embodiments, the dogbone shape in its compressed assembly is what keeps the lace knot together. However, there still needs to be a high enough coefficient of friction in the knot assembly so that it doesn't untie. It is believed that, when the lace surface compresses against itself tightly, the slip agent doesn't function in the same way when the lace is uncompressed. It is like the grippyness of the TPU comes back when compressed against itself. The slip agent also makes it easier for the user to pull the lace through the eyelets during installation.

In usage, the user may install the improved lacing device in a shoe and tie it. The user then may utilize the flexibility of the improved lacing device to remove the shoe without untying it. The improved lacing device holds well with elasticity due to the materials used, so the materials will not fatigue very much over time.

Figure 5B:
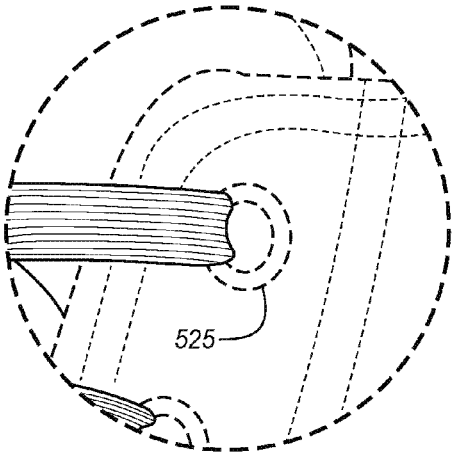
FIGS. 5A and 5B shows the improved lacing device of FIG. 1 in use.
Figure 5A:
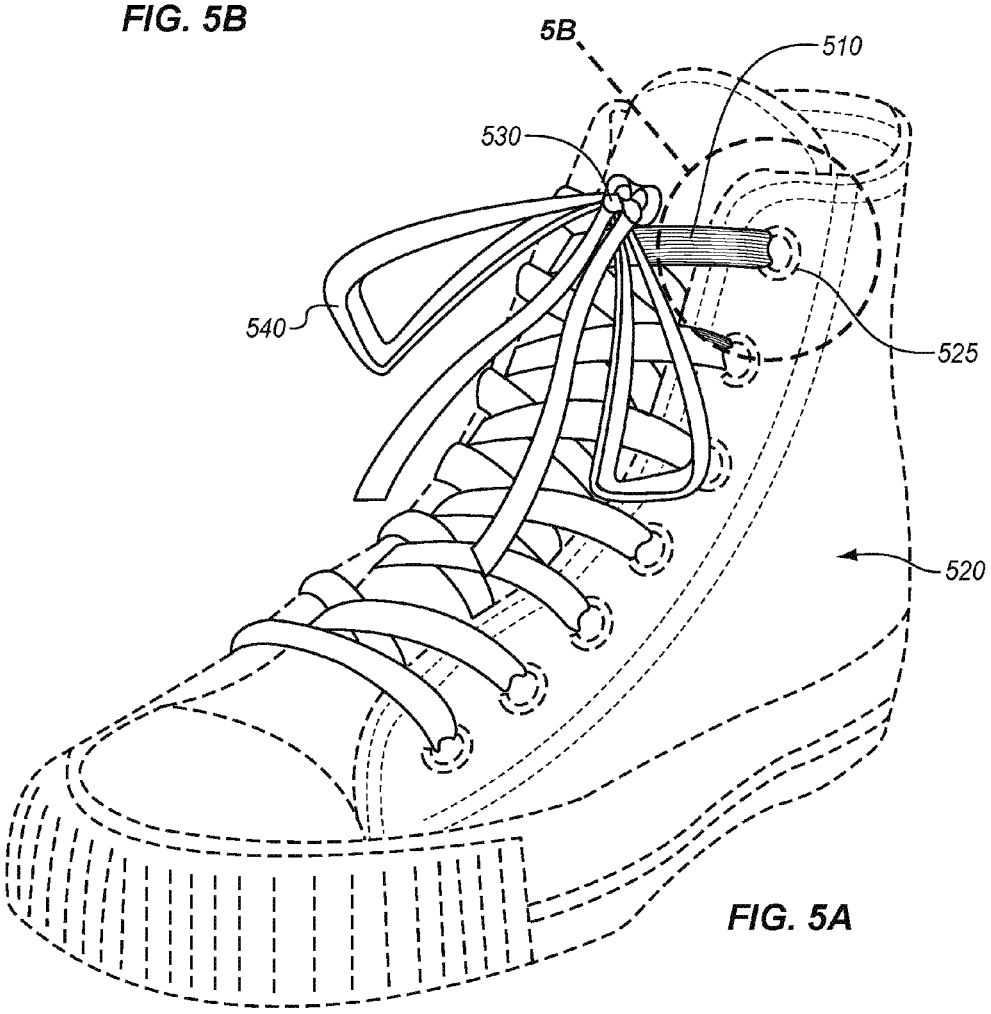

FIGS. 5A and 5B shows an embodiment of an improved lacing device 510 in usage. Improved lacing device 510 is installed in a shoe 520 that includes eyelets 525. Some of the detail of the ribs are omitted in this figure for easy of viewing. A number of features of the improved lacing device 500 are visible in this figure. First, due to the slip additive, the improved lacing device passes more easily through eyelets 525. Additionally, during the process of tying the improved lacing device 510, the slip coating provides for easier typing of the laces. This is because TPU has a comparatively high coefficient that prevents the laces from sliding against each other without the addition of the slip additive. Without the slip additive, the user would experience increased difficulty tying the improved lacing device 510 and passing the improved lacing device 510 through eyelets 525. Additionally, at tie 530 it is visible that the improved lacing device 510 has folded about itself. This folding is also shown in the bow areas 540 of the improved lacing device 510. The slip additive does not affect the improved lacing device 510 enough so that it will untie, especially considering the gripping offered by the improved folding and ribs.

The previous detailed description is of a small number of embodiments for an improved lacing device and making and using the same and is not intended to be limiting in scope. The following claims set forth a number of the embodiments for an improved lacing device and making and using the same disclosed with greater particularity.

What is claimed:

1. A lacing device comprising:

a lace body, the lace body having a length, a width defined between opposing side edges, a depth defined between opposing top and bottom surfaces, and a cross-sectional area spanning the width and the depth of the lace body, the cross-sectional area of the lace body shaped such that the lace body is prone to folding about a middle area of the width when the lace body is compressed, wherein the cross-sectional area of the lace body has a narrow profile in the depth in the middle area as compared to edge areas outside the middle area of the width, the narrow profile defining a point of minimum thickness, the point of minimum thickness defined along a longitudinal centerline of the lace body and about which the lace body folds when compressed by a force applied between the opposing side edges.

2. The lacing device of claim 1, wherein the cross-sectional area has a dogbone shape.

3. The lacing device of claim 1, wherein the lace body includes a plurality of ridges.

4. The lacing device of claim 3, wherein the plurality of ridges runs parallel to the length of the lace body.

5. The lacing device of claim 4, wherein the lace body is composed of thermal plastic urethane (TPU).

6. The lacing device of claim 5, wherein the lace body has a durometer of 65-75 shore A.

7. The lacing device of claim 5, wherein the lace body includes a slip additive.

8. The lacing device of claim 1, wherein the lace body is shaped such that a lever arm is created that stretches from an end point at an edge of the lace body to a center point of the lace body.

9. A lacing device comprising:

a lace body, the lace body having a length, a width defined between opposing side edges, a depth defined between opposing top and bottom surfaces, and a cross-sectional area spanning the width and the depth of the lace body, the cross-sectional area of the lace body shaped such that the lace body is prone to folding about a middle area of the width when the lace body is compressed, the lace body having a first configuration where the lace body is not under compressive force, and a second configuration where the lace body is under compressive force, the first configuration characterized by the lace body having a flat profile, and the second configuration characterized by the lace body being folded about the middle area of the width, wherein the cross-sectional area of the lace body has a narrow profile in the depth in the middle area as compared to edge areas outside the middle area of the width, the narrow profile defining a point of minimum thickness, the point of minimum thickness defined along a longitudinal centerline of the lace body and about which the lace body folds when compressed by a force applied between the opposing side edges.

10. The lacing device of claim 9, wherein the compressive force is a result of tying the lace body around itself.

11. The lacing device of claim 10, wherein the lace body includes a plurality of ridges, and the plurality of ridges runs parallel to the length of the lace body.

12. The lacing device of claim 11, wherein in the second configuration when the lace body is tied around itself, the plurality of ridges compresses and mechanically interacts with each other due to the compressive force.

13. The lacing device of claim 11, wherein the lace body is composed of thermal plastic urethane (TPU), the lace body has a durometer of 65-75 shore A, and the lace body includes a slip additive.

14. A method of using a lacing device, the method comprising:

providing the lacing device, the lacing device having a lace body, the lace body having a length, a width defined between opposing side edges, a depth defined between opposing top and bottom surfaces, and a cross-sectional area spanning the width and the depth of the lace body, the cross-sectional area of the lace body shaped such that the lace body is prone to folding about a middle area of the width when the lace body is compressed, wherein the cross-sectional area of the lace body has a narrow profile in the depth in the middle area as compared to edge areas outside the middle area of the width, the narrow profile defining a point of minimum thickness, the point of minimum thickness defined along a longitudinal centerline of the lace body and about which the lace body folds when compressed by a force applied between the opposing side edges;

lacing a shoe with the lacing device; and tying the lacing device, wherein the tying causes the lace body to fold about the middle area of the width.

15. The method of claim 14, further comprising stretching the lacing device to remove the shoe without untying the lacing device.

16. The method of claim 14, wherein the lace body includes a plurality of ridges, and the plurality of ridges runs parallel to the length of the lace body.

17. The method of claim 14, wherein in the second configuration when the lace body is tied around itself, the plurality of ridges compresses and mechanically interacts with each other due to the compressive force.

18. The method of claim 14, wherein the lace body is composed of thermal plastic urethane (TPU), the lace body has a durometer of 65-75 shore A, and the lace body includes a slip additive.

19. A lacing device comprising:

a lace body, wherein the lace body includes a plurality of ridges, and the plurality of ridges runs parallel to the length of the lace body, wherein the lace body has a length, a width defined between opposing side edges, a depth defined between opposing top and bottom surfaces, and a cross-sectional area spanning the width and the depth of the lace body, the cross-sectional area of the lace body shaped such that the lace body is prone to folding about a middle area of the width when the lace body is compressed, and wherein the cross-sectional area of the lace body has a narrow profile in the depth in the middle area as compared to edge areas outside the middle area of the width, the narrow profile defining a point of minimum thickness, the point of minimum thickness defined along a longitudinal centerline of the lace body and about which the lace body folds when compressed by a force applied between the opposing side edges.

20. The lacing device of claim 19, wherein the lace body is composed of thermal plastic urethane (TPU).

21. The lacing device of claim 19, wherein the cross-sectional area has a dogbone shape.

22. The lacing device of claim 19, wherein the lace body has a durometer of 65-75 shore A.

23. The lacing device of claim 19, wherein the lace body includes a slip additive.

* * * * *